US006559767B2

(12) United States Patent
Huang

(10) Patent No.: US 6,559,767 B2
(45) Date of Patent: May 6, 2003

(54) VIBRATION-SENSING ALARM DEVICE

(76) Inventor: Dennis Huang, 1 Fl., No. 1, Lane 9, Ningpo E. St., Taipei (TW)

( * ) Notice: Subject to any disclaimer, the term of this patent is extended or adjusted under 35 U.S.C. 154(b) by 0 days.

(21) Appl. No.: 09/993,573

(22) Filed: Nov. 27, 2001

(65) Prior Publication Data

US 2002/0121976 A1 Sep. 5, 2002

(30) Foreign Application Priority Data

Mar. 5, 2001 (TW) ..... 90203248

(51) Int. Cl.[7] ..... G08B 13/14

(52) U.S. Cl. ..... 340/571; 340/568.1; 340/539; 340/686.1; 340/328; 340/502; 340/505

(58) Field of Search ..... 340/571, 568.1, 340/539, 686.1, 328, 502, 505, 568.7

(56) References Cited

U.S. PATENT DOCUMENTS 4,257,038 A * 3/1981 Rounds et al. ..... 340/539
4,337,462 A * 6/1982 Lemelson ..... 340/572
4,792,796 A * 12/1988 Bradshaw et al. ..... 340/539
4,884,067 A * 11/1989 Nordholm et al. ..... 340/686
4,885,572 A * 12/1989 Iwata et al. ..... 340/425.5
5,357,560 A * 10/1994 Nykerk ..... 379/59
5,757,271 A * 5/1998 Andrews ..... 340/568
5,805,066 A * 9/1998 Murdy ..... 340/568
6,265,974 B1 * 7/2001 D'Angelo et al. ..... 340/568.1

* cited by examiner

*Primary Examiner*—Daniel J. Wu
*Assistant Examiner*—Tai T. Nguyen
(74) *Attorney, Agent, or Firm*—Bacon & Thomas

(57) ABSTRACT

A vibration-sensing alarm device has a receiving circuit for receiving radio signals transmitted from a transmitter. A decoder decodes the signals transmitted from the receiving circuit. A control switch is controlled by the decoder to be turned on or off. An alarm circuit is activated to drive an alarm module to generate an alarm when the control switch is turned on and is disabled when the control switch is turned off. A power supply and timing control is provided to supply power and timing signals to the receiving circuit, the decoder, the control switch, and the alarm circuit. A motion sensor is provided for turning on the power supply and timing control when sensing a vibration.

4 Claims, 4 Drawing Sheets

VIBRATION-SENSING ALARM DEVICE

BACKGROUND OF THE INVENTION

1. Field of the Invention

The present invention relates to an alarm device, and more particularly, to a vibration-sensing alarm device capable of preventing portable articles, such as suitcase, cellular phone or briefcase, from being lost, stolen or robbed, and detecting a malfunction of a machine.

2. Description of Related Art

Generally, as shown in FIG. 6, a conventional theft-prevented type alarm device is composed of a portable transmitter 91 and an alarm 92 placed in a personal article such as a suitcase, a cellular phone, or a briefcase. The alarm 92 comprises a receiver, a buzzer, and a switch for controlling the activation of alarm 92. The receiver of the alarm 92 can receive signals transmitted from transmitter 91 carried by a user as the distance between the user and the personal article is within a predetermined safe distance, and thus, switch of the alarm 92 is off so that no alarm is initiated. On the contrary, if the receiver of the alarm 92 cannot receive signals transmitted from transmitter 91 as the distance between user and the personal article is larger than the predetermined safe distance, the switch of the alarm 92 is on, resulting in issuing a sound alarm, thereby notifying the user that that the carried article is lost or stolen.

Above conventional theft-prevented type alarm device may be disadvantageous in practice. For example, the user may forget to turn off the alarm while temporarily leaving the briefcase. However, alarm as designed will activate if the distance between user and the briefcase is larger than the predetermined safe distance. This can really embarrass the user in a public place. Moreover, a thief may not be shocked simply by a sound alarm. Therefore, it is desirable to provide an improved alarm device in order to mitigate and/or obviate the aforementioned problems.

SUMMARY OF THE INVENTION

An object of the present invention is to provide a vibration-sensing alarm device capable of accurately activated to effectively inhibit a potential theft or robbery.

Another object of the present invention is to provide a vibration-sensing alarm device for automatically monitoring the operation of a machine.

In one aspect of the present invention, there is provided a vibration-sensing alarm device, which comprises: a receiving circuit for receiving radio signals transmitted from a transmitter; a decoder for decoding the signals transmitted from the receiving circuit; a control switch controlled by the decoder to be turned on or off; an alarm circuit which is activated to drive an alarm module to generate an alarm when the control switch is turned on and which is disabled when the control switch is turned off; a power supply and timing control for supplying power and timing signals to the receiving circuit, the decoder, the control switch, and the alarm circuit; and a motion sensor for turning on the power supply and timing control when sensing a vibration.

In another aspect of the present invention, there is provided a vibration-sensing alarm device, which comprises: a transmitter including a transmitting circuit for transmitting radio signals, a power supply control for providing a required operating power to the transmitting circuit, and a motion sensor for turning on the power supply control when sensing a vibration; and a receiver including a receiving circuit for receiving signals transmitted from the transmitter, a decoder for decoding the signals transmitted from the receiving circuit, a control switch controlled by the decoder to be turned on or off, an alarm circuit which is activated to drive an alarm module to generate an alarm when the control switch is turned on and which is disabled when the control switch is turned off.

Other objects, advantages, and novel features of the invention will become more apparent from the detailed description when taken in conjunction with the accompanying drawings.

DETAILED DESCRIPTION OF THE PREFERRED EMBODIMENT

Figure 1:
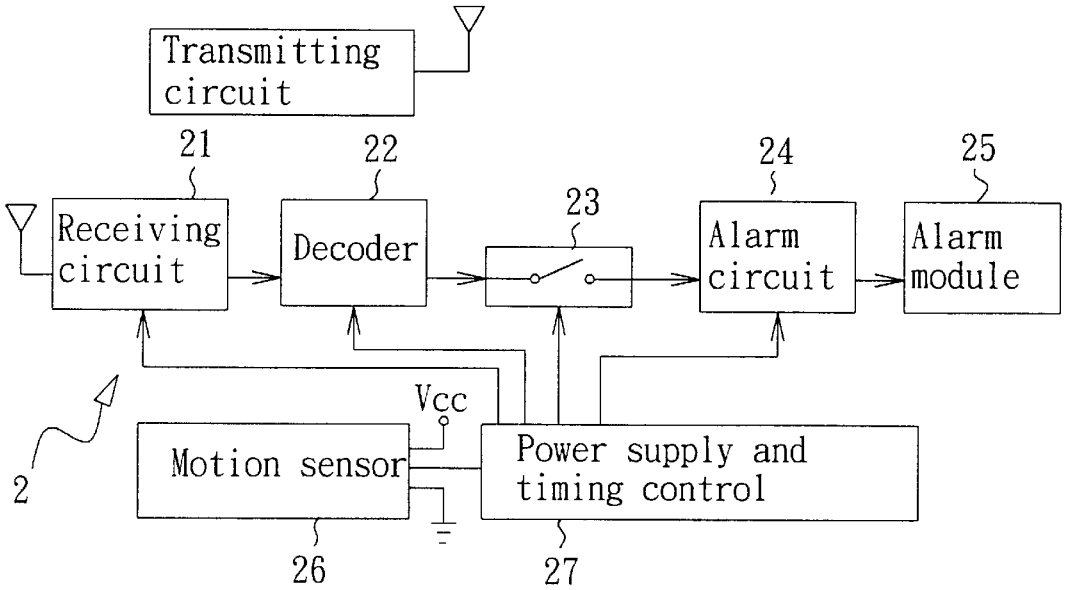
FIG. 1 is a block diagram of a first preferred embodiment of the vibration-sensing alarm device according to the present invention.

With reference to FIG. 1, there is shown a vibration-sensing alarm device constructed in accordance with a first preferred embodiment of the present invention, which comprises a receiver 2 and a transmitter 1 carried by user. The receiver 2 comprises a receiving circuit 21, a decoder 22, a control switch 23, an alarm circuit 24, an alarm module 25, a motion sensor 26, and a power supply and timing control 27. The transmitter 1 comprises a radio signal transmitting circuit capable of continuously transmitting radio signals to the receiver 2 so that the receiver senses whether a distance between the transmitter 1 and receiver 2 is within a predetermined safe distance.

Figure 2:
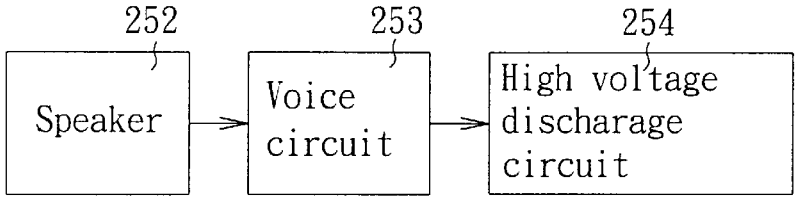
FIG. 2 is a block diagram of the alarm module of FIG. 1.

The motion sensor 26 is provided to sense whether the receiver 2 mounted in a suitcase, a cellular phone, a briefcase, or the like is vibrated or not. The result of sensing determines whether to turn on the power supply and timing control 27. The power supply and timing control 27 can provide required operating power and timing signals to the receiving circuit 21, the decoder 22, the control switch 23, and the alarm circuit 24. The receiving circuit 21 can receive radio signals transmitted from the transmitter 1. The decoder 22 decodes the received radios signals into control signals for being sent to the control switch. The control switch 23 can perform a corresponding on/off operation in response to the control signals. The alarm circuit 24 is disabled when the control switch 23 is off while is enabled when the control switch 23 is on for activating the alarm module 25 to generate an alarm. The alarm module 25 can be buzzer or, as shown in FIG. 2, comprises a speaker 252, a voice circuit 253, and a high voltage discharge circuit 254 so as to provide an enhanced protection mechanism.

Figure 3:
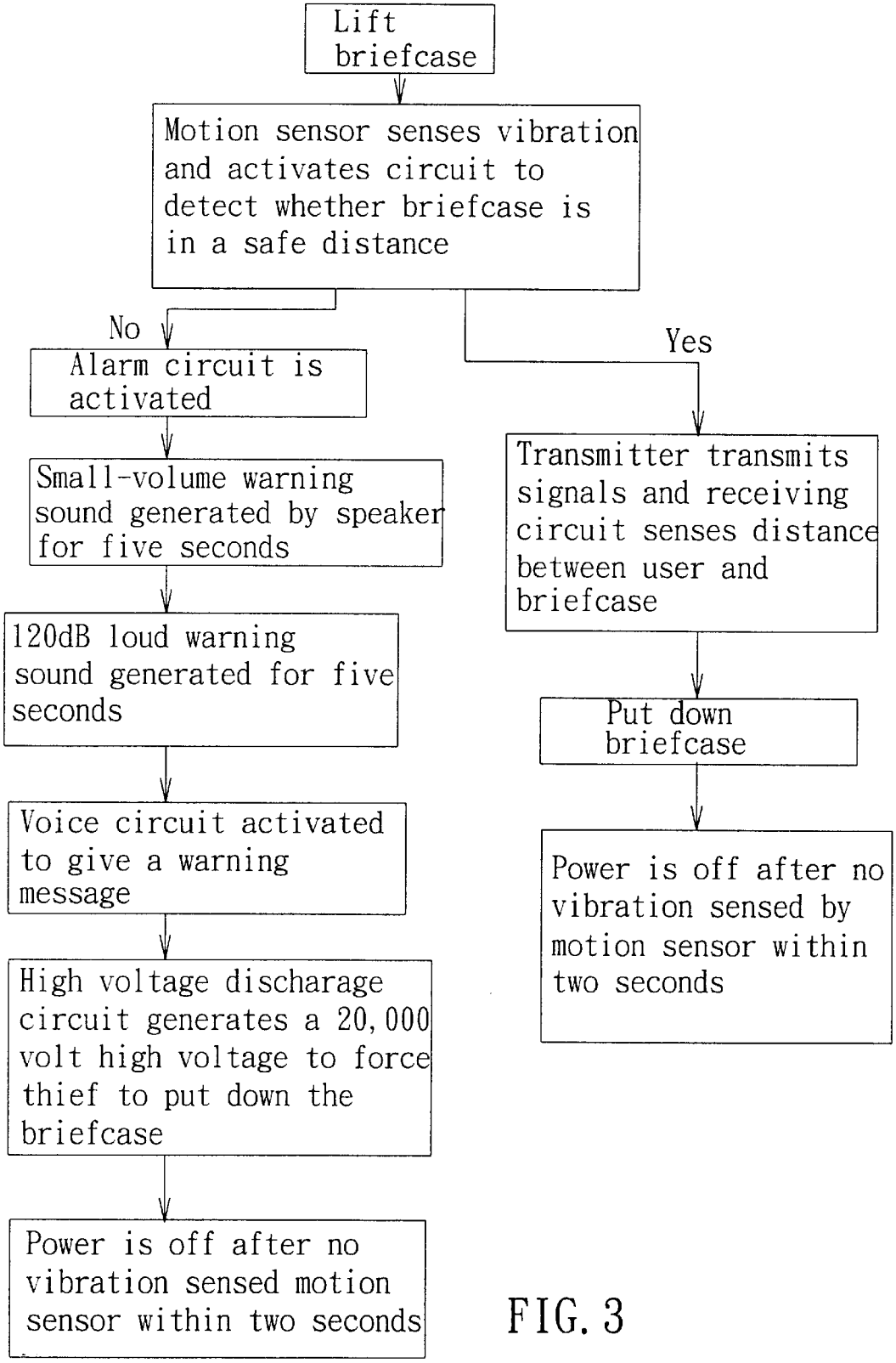
FIG. 3 is a flow chart illustrating an alarm activation process of the alarm device in FIG. 1.

With reference to FIG. 3, there is shown a process illustrating an operation of the alarm device in accordance with the present invention. Once an article (e.g., briefcase) carried with the receiver 2 of the alarm device is moved, the receiver 2 is thus vibrated and the motion sensor 26 can sense the vibration so as to turn on the power supply and timing control 27. Accordingly, the receiving circuit 21, the decoder 22, the control switch 23, and the alarm circuit 24 are supplied with power and timing signals, thereby activating the alarm device.

At this moment, if the article is moved by the user, the distance between the user and the carried briefcase is within the predetermined safe distance, and thus radio signals transmitted from transmitter can be correctly received by the receiving circuit 21. The received signals are decoded by the decoder 22 into control signals to turn off the control switch 23. Hence, the alarm module 25 will not be activated by the alarm circuit 24 so that no alarm is generated. Since the transmitter 1 continuously transmits signals, the receiving circuit 21 can receive the transmitted signals so as to sense the distance between the user and the carried briefcase. When the user puts down the briefcase, the motion sensor 26 will not sense any vibration, and after two seconds, automatically turn off the power supply and timing control 27. Moreover, the receiver 2 is also disabled.

On the contrary, if the motion sensor 26 turns on the power supply and timing control 27 when sensing a movement of the briefcase and signals transmitted from the transmitter 1 are not correctly received by the receiving circuit 21, the control switch 23 is turned on by the decoder 22. Hence, the alarm circuit 24 is activated for driving the alarm module 25 to generate an alarm. In an example that the alarm module 25 is implemented as a buzzer, the buzzer is driven to generate a warning sound to notify the user.

In order to enhance the alarming effect, as shown in FIG. 2, the alarm module 25 comprises a speaker 252, a voice circuit 253, and a high voltage discharge circuit 254. In this case, the alarm module 25 is driven by the alarm circuit 24 to perform following warning actions:

(1) The speaker 252 is driven to generate a small-volume warning sound lasted for about three seconds for being used as a pre-alarm.

(2) Then, a loud warning sound of 120 dB is generated for about five seconds.

(3) Next, the voice circuit 253 is activated to give a pre-recorded message such as "electroshock", "danger", "put down immediately", etc.

(4) Finally, the high voltage discharge circuit 254 is activated to generate a high voltage of about 20,000 volt to force the thief to put down the briefcase. After the briefcase is put down and there is no vibration sensed by the motion sensor 26 within a predetermined period of time (e.g., two seconds), the power supplied to the receiver 2 will be turned off automatically, and the electric shock is stopped.

Moreover, if there is no vibration sensed by the motion sensor 26 within the predetermined period of time during an operation of any one of above (1) to (4) processes, the power supply and timing control 27 is turned off and thus alarm to be generated is disabled. At this moment, the user holding the transmitter 1 can safely take back the article. As a result, the purpose of inhibiting theft is fulfilled.

Figure 4:
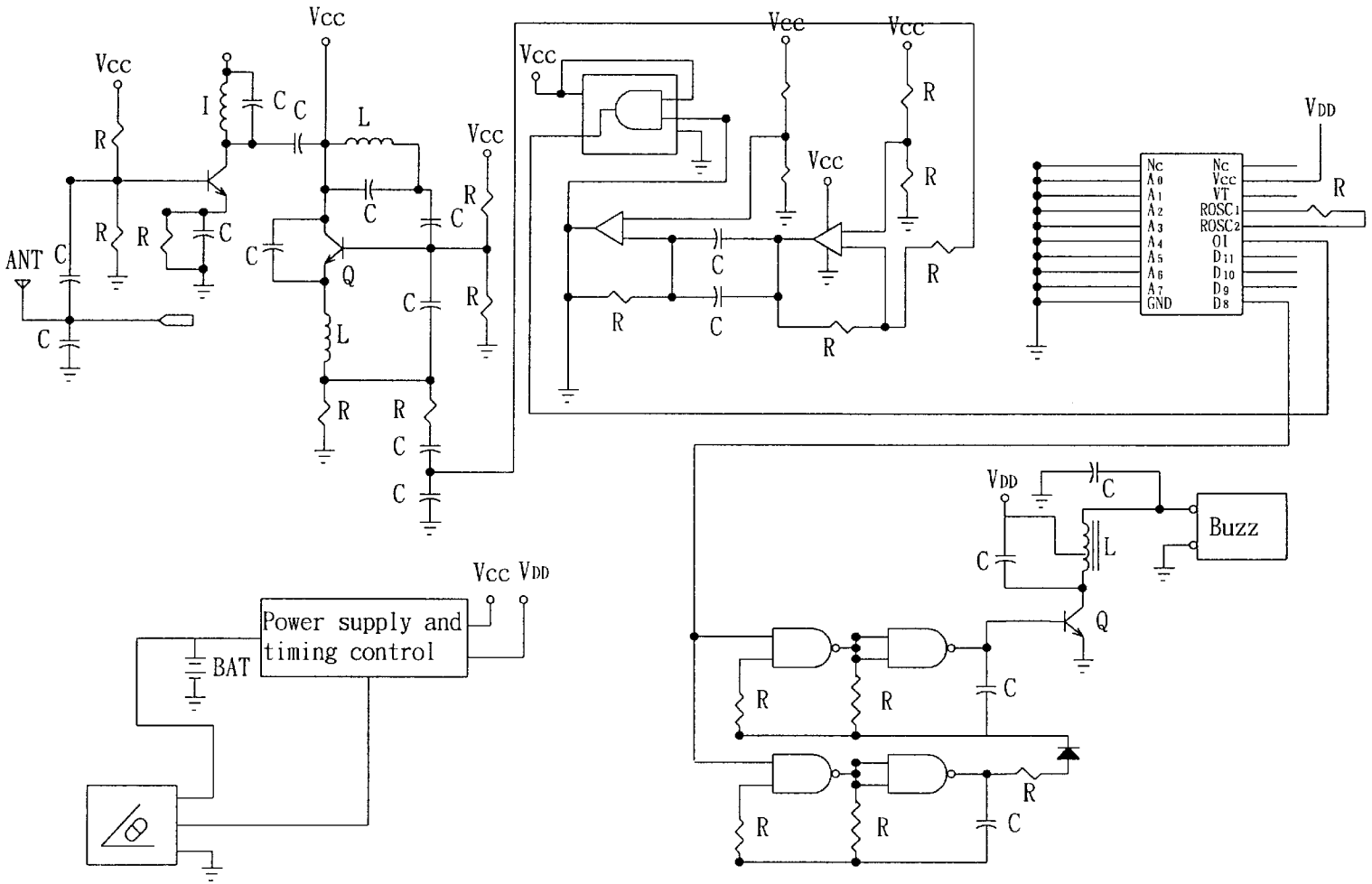
FIG. 4 is a detailed circuit diagram of the alarm device in FIG. 1.

The above receiver 2 of alarm device may be mounted on a precious equipment in an office, and only the user carrying the transmitter 1 can move that equipment so as to prevent the equipment from being stolen. The alarm device of the present invention can be realized by electronic elements and an implementation of alarm device is shown in the FIG. 4.

Figure 5:
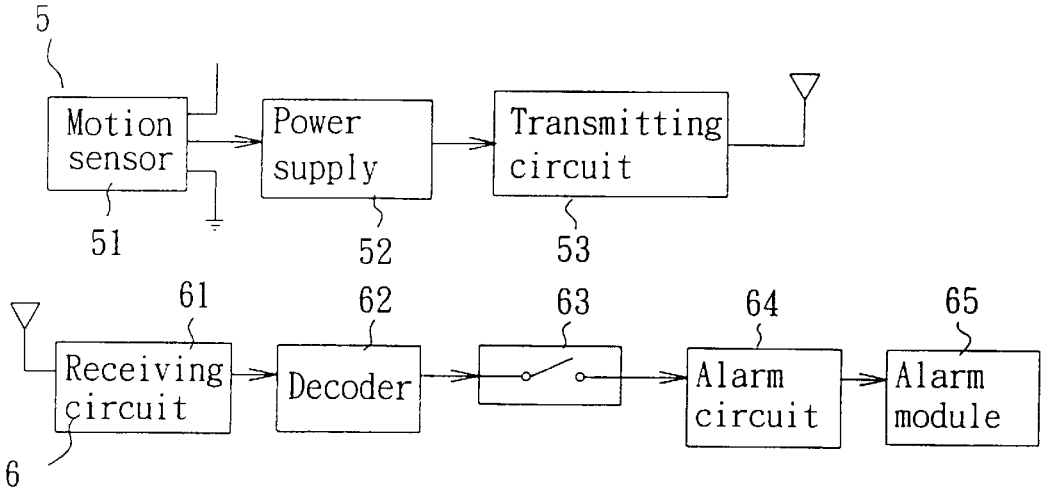
FIG. 5 is a block diagram of a second preferred embodiment of the vibration-sensing alarm device according to the invention.
Figure 6:
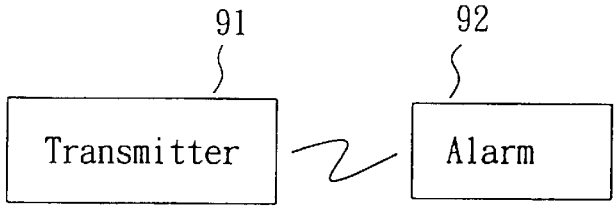
FIG. 6 PRIOR ART
FIG. 6 is a block diagram of a conventional theft-prevented type alarm device.

With reference to FIG. 5, there is shown a circuit block diagram of a second preferred embodiment of alarm device according to the present invention. As shown, the transmitter 5 comprises a motion sensor 51, a power supply control 52, and a transmitting circuit 53. The receiver 6 comprises a receiving circuit 61, a decoder 62, a control switch 63, an alarm circuit 64, and an alarm module 65. The receiver 6 can receive radio signals transmitted from the transmitter 5.

The transmitter 5 is mounted on a machine. The motion sensor 51 can sense a vibration if that machine is running normally. And in turn, the power supply control 52 is operated to supply power to the transmitting circuit 53 which is thus activated to continuously transmit radio signals to the receiver 6 with a predetermined power. Furthermore, when signals transmitted from transmitter 5 are correctly received by the receiving circuit 61, the received signals are decoded by the decoder 62 to turn off the control switch 63. Hence, the alarm module 65 will not be activated by the alarm circuit 64, and no alarm is generated.

Since the transmitter 5 mounted on the machine continuously transmits signals, the receiving circuit 61 can receive the transmitted signals so as to determine whether the machine is running normally. In the case that the machine is stopped due to malfunction, the motion sensor 51 will not sense the vibration. As such, the power supply control 52 is disabled immediately. Then, the transmitting circuit 53 stops transmitting signals. At this moment, signals transmitted from the transmitter 5 are not correctly received by the receiving circuit 61. As a result, the control switch 63 is turned on by the decoder 62. Hence, the alarm circuit 64 is activated for driving the alarm module 65 to generate an alarm. In an example that the alarm module 65 is implemented as a buzzer or an indicator lamp, a warning sound or light is generate to notify the user. Also, the alarm module 65 may comprise a communication port for sending alarm signals to a remote control center in a wireless or wired manner, thereby providing a remote monitoring capability.

In view of the foregoing, it is known that the activation of alarm device of the present invention is enabled or not depending on whether the article or machine is vibrated or not. This ensures that the alarm device is activated only when the article is stolen or robbed. Also, techniques provided by the alarm device such as voice warning or electroshock can ensure that the article is not far away from the user when it is stolen. Moreover, once the stolen article is put down, the alarm device is disabled immediately and thus the owner can take back the article safely. In case that the transmitter is mounted on a machine, alarm is activated only when the machine stops running, so as to automatically monitor the running of the machine.

Although the present invention has been explained in relation to its preferred embodiment, it is to be understood that many other possible modifications and variations can be made without departing from the spirit and scope of the invention as hereinafter claimed.

What is claimed is:

1. A vibration-sensing alarm device comprising:

a receiving circuit for receiving radio signals transmitted from a transmitter when a distance between the transmitter and the receiving circuit is less than a predetermined distance;

a decoder for decoding the signals transmitted from the receiving circuit;

a control switch controlled by the decoder to be turned on when the receiving circuit fails to receive signals from the transmitter, indicating that the transmitter is farther than the predetermined distance away from the receiving circuit, and to be turned off when the receiving circuit receives signals from the transmitter, indicating that the transmitter is less than the predetermined distance away from the receiving circuit;

an alarm circuit which is activated to drive an alarm module to generate an alarm when the control switch is turned on and a vibration is sensed, and which is disabled when the control switch is turned off;

a power supply and timing control circuit for supplying power and timing signals to the receiving circuit, the decoder, the control switch, and the alarm circuit; and a motion sensor for turning on the power supply and timing control circuit when sensing a vibration, wherein turning on of the power supply and timing control circuit causes said alarm circuit to be activated only when the control switch is turned on, and said control switch is turned on only when said transmitter is farther than the predetermined distance away from the receiving circuit.

2. The vibration-sensing alarm device as claimed in claim 1, wherein, when the motion sensor has sensed a vibration and an alarm is given by the alarm module, the power supply and timing control will be disabled for stopping the alarm if there is no further vibration sensed by the motion sensor within a predetermined period of time.

3. The vibration-sensing alarm device as claimed in claim 2, wherein the alarm module is a buzzer.

4. The vibration-sensing alarm device as claimed in claim 2, wherein the alarm module comprises a speaker, a voice circuit, and a high voltage discharge circuit, and wherein, in response to an activation of the alarm module, the speaker is driven to generate a small-volume warning sound for several seconds and then a loud warning sound for several seconds; next, the voice circuit is activated to give a pre-recorded warning message; and finally the high voltage discharge circuit is activated to generate a high voltage.

* * * * *